US006737599B1

(12) United States Patent
Lewis

(10) Patent No.: US 6,737,599 B1
(45) Date of Patent: May 18, 2004

(54) MOTOR STARTING SWITCH

(75) Inventor: William R. Lewis, Hazelwood, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/629,194

(22) Filed: Jul. 29, 2003

(51) Int. Cl.[7] ..... H01H 1/06; H01H 1/58
(52) U.S. Cl. ..... 200/557; 200/284; 200/275
(58) Field of Search ..... 200/6 R, 6 BB, 200/6 C, 16 R, 16 A, 16 C, 16 D, 532–535, 553–559, 1 A, 246, 405–408, 284; 318/782, 785, 793

(56) References Cited

U.S. PATENT DOCUMENTS 4,177,367 A * 12/1979 Tirone et al. ..... 200/535
4,296,366 A 10/1981 Hildebrandt et al. ..... 319/793
4,480,937 A * 11/1984 Eckhardt ..... 400/479
4,658,107 A 4/1987 Hildebrandt ..... 200/80 R
5,664,666 A 9/1997 Filla ..... 200/246
5,744,883 A 4/1998 Lewis et al. ..... 310/68 E
6,184,484 B1 2/2001 Wade, III ..... 200/284
6,222,144 B1 * 4/2001 Nishikawa ..... 200/537
6,507,266 B1 * 1/2003 Bizard et al. ..... 337/349
6,525,639 B1 * 2/2003 Cheng ..... 337/37
6,538,553 B2 * 3/2003 Yu ..... 337/365

* cited by examiner

*Primary Examiner*—Michael A. Friedhofer
(74) *Attorney, Agent, or Firm*—Senniger, Powers, Leavitt & Roedel

(57) ABSTRACT

A switch for an electric motor which inhibits vibratory noise during operation of the motor. The switch includes a housing with a wall, an electrical terminal, and a flexible switch arm. A control lever is engageable with the switch arm to actuate movement of the switch arm between positions engaging or disengaging the electrical terminal. A cantilevered spring urges movement of the lever toward a generally stationary position against the wall of the housing to inhibit vibration of the lever during operation of the motor. The spring is attached to the switch arm.

17 Claims, 2 Drawing Sheets

MOTOR STARTING SWITCH

BACKGROUND OF THE INVENTION

This invention relates generally to electric motors, and in particular to a switch for starting an electric motor that inhibits vibration and associated noise during operation of the motor.

Capacitor start and split phase induction motors, such as motors used in appliances (e.g., clothes dryers), typically have a run winding and a starting winding placed in a stator assembly. The starting winding is energized during start-up of the motor, or when the speed of the motor falls below a specified operating speed, so as to create a rotating field in the stator and to apply sufficient torque to the rotor for starting purposes. However, once the motor has accelerated to a desired operating speed, or a predetermined percentage thereof, the rotor is able to follow the alternations of the magnetic field created by the run winding, and the starting winding is no longer needed. The starting winding is not intended for continuous use and may fail if not de-energized during normal operation of the motor. Consequently, a two-position starting switch is provided with the motor for energizing the starting winding only during start-up of the motor and for de-energizing the starting winding once the motor has attained its desired operating speed. Reference is made to co-assigned U.S. Pat. No. 4,296,366, U.S. Pat. No. 5,744,883, and U.S. Pat. No. 6,184,484, each of which is hereby incorporated by reference, for additional detail regarding switches of this type.

These motor starting switches are conventionally actuated by a centrifugal actuator mounted on and rotatable with the rotor shaft of the motor. The centrifugal actuator is responsive to the speed of the motor for actuating the starting switch from its start to its run position in response to the motor attaining a predetermined operating speed. The centrifugal actuator engages a lever of the switch and moves the lever to change one or more electrical contacts in the switch. The lever pushes one or more metallic spring arms into or out of contact with corresponding electrical terminals, thereby energizing one of the windings and de-energizing the other winding. Typically, the lever pushes the spring arm at the start position of the switch, and releases the spring arm at the run position of the switch. Unfortunately, the lever has a tendency to vibrate and create a rattling noise during normal operation of the motor. At its run position, the lever does not carry a substantial load and, due to design tolerances, is free to move a small distance within the switch. That permits the lever to oscillate, at a frequency depending on the motor, and engage nearby parts which produces an objectionable noise. The tendency to vibrate is aggravated by the lever being made of a lightweight material such as plastic.

In response to that tendency, some manufacturers have installed a coil spring inside each switch. The spring urges the lever toward engagement with another component, such as an external wall of the switch housing, so that the lever remains generally stationary when at its run position and does not rattle. The force of the spring may be readily overcome by the centrifugal actuator for moving the lever to its start position. Unfortunately, the coil spring adds cost, increases complexity during manufacture, and degrades reliability of the switch.

SUMMARY OF THE INVENTION

Among the several objects and features of the present invention may be noted the provision of a switch for an electric motor which inhibits vibratory noise; the provision of such a switch which is reliable in operation; and the provision of such a switch which is economical to produce.

In general, a switch according to the present invention is for an electric motor. The switch comprises a housing including a wall and an electrical terminal within the housing. A flexible switch arm has a fixed end secured within the housing and a free end movable between a first position in which the arm engages the electrical terminal making an electrical contact therebetween which affects operation of the motor, and a second position in which the arm is spaced from the electrical terminal and free of the electrical contact. A movable control is engageable with the switch arm to actuate movement of the switch arm between the first and second positions. A biasing member is for urging movement of the control toward a generally stationary position against the wall of the housing to inhibit vibration of the control during operation of the motor. The biasing member is attached to the switch arm.

In another aspect, the present invention involves an improved switch for an electric motor having a wall defining a housing and an electrical terminal in the housing. A flexible switch arm has a fixed end and a free end movable between a first position in which the arm engages the electrical terminal making an electrical contact affecting operation of the motor and a second position In which the arm is spaced from the electrical terminal. A pivotally mounted lever is engageable with the switch arm for movement of the switch arm between the first and second positions. The improvement comprises a cantilevered spring attached to the switch arm and engaging the lever to urge the lever toward a generally stationary position against the wall of the housing to thereby inhibit vibration of the lever during operation of the motor.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
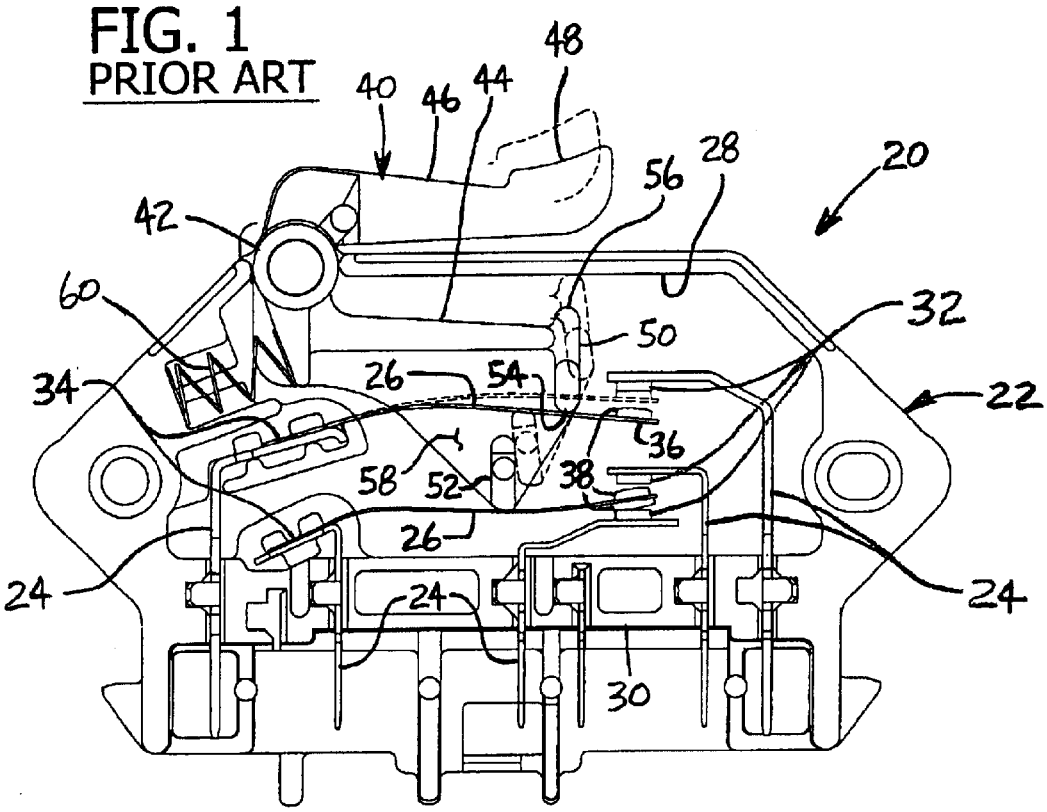
FIG. 1 PRIOR ART
FIG. 1 is a schematic side elevation of a switch of the prior art.
Figure 2:
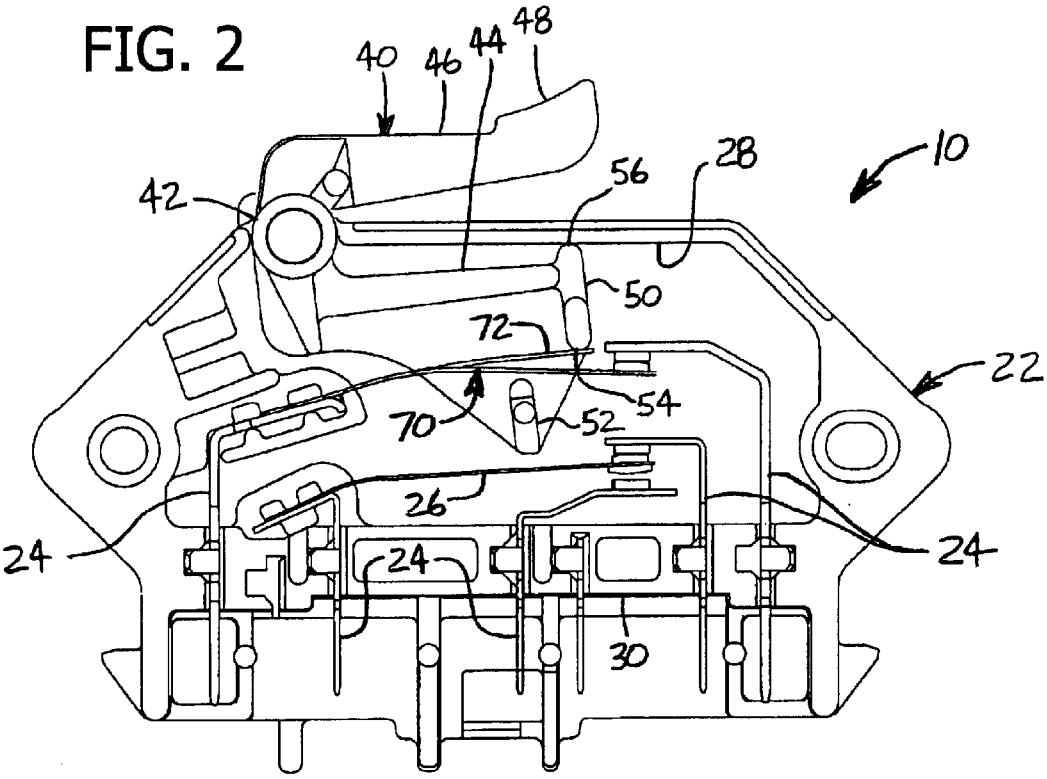
FIG. 2 is a view similar to FIG. 1 of a switch according to the present invention.

Referring now to the drawings and in particular to FIG. 2, a switch according to one embodiment of the present invention is indicated generally at 10. The switch 10 is intended for use with an electric motor (not shown), such as a capacitor start or split phase induction motor, but it may have other applications. In one embodiment, the switch 10 comprises a starting switch for selectively energizing and de-energizing a starting winding and a run winding of the motor. However, the switch may be used in a variety of applications for changing electric circuits without departing from the scope of this invention. As described below, the switch is an improvement to a switch 20 of the prior art shown in FIG. 1.

The switch 20 of FIG. 1 includes a housing indicated generally at 22, several electrical terminals 24, and two flexible switch arms 26 which are engageable with selected terminals. By making or releasing electrical contact between a switch arm 26 and a terminal 24, a corresponding electrical circuit is completed or opened, respectively, to affect operation of the motor.

The housing 22 defines a hollow enclosure having a peripheral wall 28 and a support formation 30 for supporting the electrical terminals 24. The housing 22 has a shape and size suitable for mounting the switch either in the electric motor or adjacent to it. A removable front cover (not shown) covers the interior of the housing 22. The housing is preferably molded from a suitable rigid and electrically insulative material, such as a plastic or synthetic resin.

The electrical terminals 24 comprise thin strips which are made of a generally rigid and electrically conductive material (e.g., a brass alloy). Each terminal 24 has a bent shape with a generally L-shaped profile suitable for mounting in the housing 22 and making electrical connection with a switch arm 26. The terminals 24 are mounted in fixed position, being received through slots formed in the support formation 30 of the housing. Each terminal 24 extends to a position adjacent a side of the housing 22 (the lower side in FIG. 1) suitable for connection with other components of electrical circuitry (not shown) in the motor. Electrical contacts, as indicated at 32, are carried on selected terminals.

Each switch arm 26 has a fixed end 34 secured to one of the electrical terminals 24 by a rivet, tack weld, or other suitable connection. A free end 36 of each arm carries an electrical contact 38. The arm 26 is flexible and made of a suitable resilient and electrically conducting material, such as beryllium copper. The free end 36 is movable between a first position in which the arm 26 engages an electrical terminal 24 making an electrical contact therebetween (shown for one arm by a dashed line in FIG. 1), and a second position in which the arm is spaced from the electrical terminal. The switch arm 26 may be engageable with only a single terminal 24 such that electrical contacts 38 cooperate with electrical contacts 32 to form a single pole single throw switch, as shown by the upper arm 26 on FIG. 1. Alternatively, the free end of the arm may be mounted between two terminals 24 forming a single pole double throw switch, as shown by the lower arm 26 on FIG. 1. Each arm 26 is formed so that it is normally spring biased into engagement with a respective contact 32, which is conventionally the run position of the switch wherein the run winding of the motor is energized.

A lever indicated generally at 40 (broadly, a "control") is engageable with at least one of the switch arms 26 for actuating movement of the arm(s). The lever 40 is pivotally mounted on the housing 22 at a central hub 42, and has an inner leg 44 inside the housing and an outer leg 46 outside the housing. A tip of the outer leg 46 includes an engagement surface 48 defining a cam follower for engagement with a centrifugal actuator (not shown) mounted on the rotor shaft of the motor. The centrifugal actuator is responsive to speed of the motor for controlling its position and moving the lever 40. Conventionally, the lever 40 is responsive to the centrifugal actuator to reside in one of two positions corresponding with the run and start conditions of the motor. The lever is formed of a suitable rigid material, such as a plastic.

The inner leg 44 of the lever is shaped to engage one or both of the switch arms 26. It includes first and second abutments 50, 52 comprising tabs integral with the lever 40 and oriented generally perpendicularly to the switch arms 26. The first abutment 50 (the upper abutment on FIG. 1) is located generally at a tip of the inner leg 44. That abutment includes a first end 54 engageable with the switch arm 26 and an opposite, second end 56 engageable with the wall 28 of the housing. The second abutment 52 extends from a portion of the lever 40 comprising a panel 58 which passes behind the upper switch arm 26 and permits rotation of the lever without the panel engaging the switch arm.

Because the lever 40 is conventional, it will not be described in further detail.

The switch 20 includes a coil spring 60 extending between the housing 22 and the lever 40. The purpose of this spring is to prevent rattling noise by dampening vibration of the lever 40 during operation of the motor. The coil spring 60 urges the lever 40 to rotate to a position such that the second end 56 of the first abutment 50 engages the wall 28 of the housing. Consequently, the lever remains generally stationary and creation of vibratory noise is avoided. The force exerted by the spring 60 on the lever 40 is readily overcome by intentional movement of the lever, such as when the centrifugal actuator moves the switch to a start position.

The switch 10 shown in FIG. 2 is substantially identical to the switch 20 of FIG. 1 (and corresponding parts are designated by corresponding reference numbers), except that the switch 10 has no coil spring 60 positioned against the housing. Instead, a dual-purpose switch arm, indicated generally at 70, is provided (the upper switch arm on FIG. 2). The arm 70 includes a biasing member 72 engaging the first end 54 of the abutment 50 to urge the abutment toward the wall 28 of the housing. The biasing member 72 comprises a cantilevered spring extending from the switch arm 70 and engaging the inner leg 44 of the lever 40 to urge the lever toward a generally stationary position against the wall of the housing thereby to inhibit vibration of the lever during operation of the motor. The cantilevered spring 72 has a proximal end connected to the switch arm 70 generally adjacent the fixed end 34 of the switch arm and a free distal end. Whereas the free end 36 of the switch arm 70 is prevented from moving above the corresponding electrical terminal 24 by engagement therewith, the spring 72 is shorter than the switch arm so that the spring is not restricted in upward movement until it engages the abutment 50. Engagement of the cantilever spring 72 with the abutment provides a larger moment arm for rotation of the lever 40 about its hub 42 than does the prior art coil spring 60 of FIG. 1. Therefore, the force applied by the spring 72 is more effective in dampening vibration. It is understood that biasing members having other forms, such as other spring configurations including coil springs, do not depart from the scope of this invention. For example, the spring 72 may be longer than the switch arm 70. In this configuration (not shown), the spring has a lateral position which avoids contact with the terminal 24 for vertical movement past the terminal while extending horizontally adjacent to it. In yet another embodiment (not shown), the dual-purpose switch arm 70 is the lower switch arm, with the upper switch arm 26 being conventional.

Figure 3:
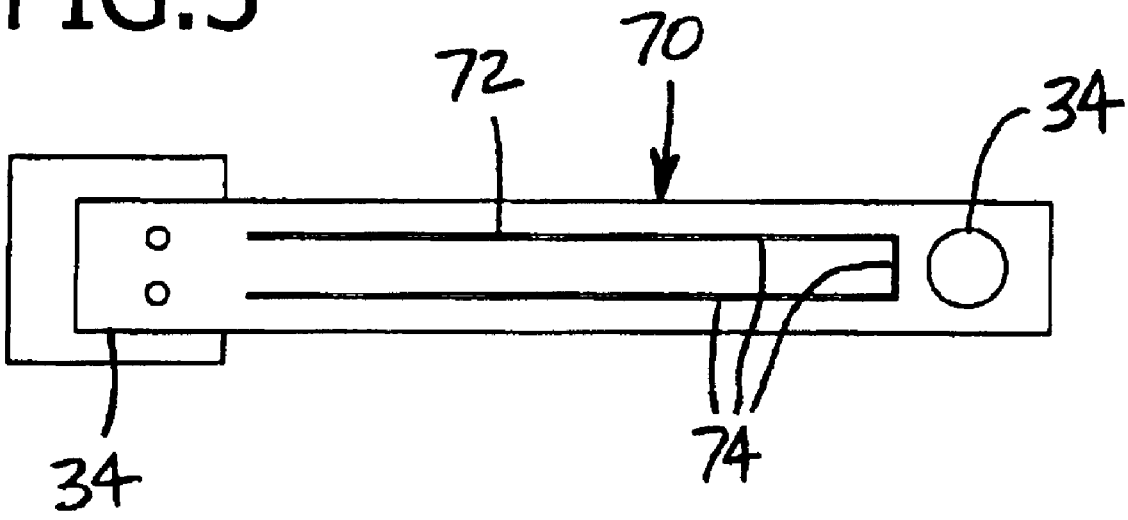
FIG. 3 is a plan view of a flexible switch arm and cantilevered spring.

Referring to FIG. 3, the cantilevered spring 72 comprises an integral portion of the switch arm 70. In this particular embodiment, the spring 72 is formed by cutting through the switch arm 70 along cut lines 74 defining the edges of the spring. Advantageously, a proximal end of the spring 72 is connected to the switch arm at a position generally adjacent the fixed end 34 of the switch arm 70 to provide the spring with a long beam length so that its free end deviates a sufficient spacing from the switch arm to engage the abutment 50 and apply force against it. The spring 72 is sized so that the remaining portion of the switch arm 70 has sufficient area for carrying the necessary electrical current for the switch 10. The force exerted by the spring 72 on the lever 40 is readily overcome by intentional movement of the lever, such as when the centrifugal actuator moves the switch to a start position. As shown in FIG. 3, the spring 72 is an elongate rectangular strip extending generally along a longitudinal centerline of the switch arm 70. However, the spring may have other shapes and locations. For example, the spring may be located along one or both of the lateral sides of the switch arm. Further, the spring can be a separate piece which is attached to the switch arm in a suitable manner.

Thus, the switch arm 70 of the present invention accomplishes two purposes. First, it makes selected electrical contacts to control operation of the motor. Secondly, it dampens rattle of the lever 40. It reduces cost of manufacture by eliminating the coil spring part and the time required to install it, and improves reliability in operation by avoiding a potential source of failure as when the coil spring 60 becomes dislodged or breaks.

It is understood that a switch with a different number of terminals and switch arms, including a single terminal or switch arm, does not depart from the scope of this invention. The lever may engage only one switch arm and/or have only one abutment. Moreover, the lever may have no abutments but engage a switch arm with other portions, e.g., the body of the inner leg. It is also understood that the switch may have a control for moving the arm(s) which has a form other than lever (e.g., a translating rod).

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A switch for an electric motor comprising:

a housing including a wall;

an electrical terminal within the housing;

a flexible switch arm having a fixed end secured within the housing and a free end movable between a first position in which the arm engages the electrical terminal making an electrical contact therebetween which affects operation of the motor, and a second position in which the arm is spaced from the electrical terminal and free of said electrical contact;

a movable control engageable with the switch arm to actuate movement of the switch arm between said first and second positions; and a biasing member for urging movement of the control toward a generally stationary position against the wall of the housing to inhibit vibration of the control during operation of the motor;

wherein the biasing member is attached to the switch arm.

2. A switch as set forth in claim 1 wherein the biasing member is integrally formed with the switch arm.

3. A switch as set forth in claim 1 wherein the biasing member comprises a cantilevered spring.

4. A switch as set forth in claim 3 wherein the cantilevered spring has a proximal end connected to the switch arm generally adjacent the fixed end of the switch arm, and a free distal end.

5. A switch as set forth in claim 3 wherein the cantilevered spring comprises an integral portion of the switch arm extending longitudinally of the switch arm.

6. A switch as set forth in claim 5 wherein said integral portion of the switch arm comprises an elongate rectangular strip.

7. A switch as set forth in claim 1 wherein the control comprises a lever pivotally mounted on the housing.

8. A switch as set forth in claim 7 wherein the lever has an inner leg inside the housing and an outer leg outside the housing, and wherein the biasing member engages the inner leg.

9. A switch as set forth in claim 8 wherein the inner leg of the lever includes an abutment located generally at a tip of the inner leg for engaging the switch arm.

10. A switch as set forth in claim 9 wherein the abutment includes a first end engageable with the switch arm and an opposite, second end engageable with the wall of the housing.

11. A switch as set forth in claim 10 wherein the biasing member engages the first end of the abutment to urge the inner leg of the lever toward the wall of the housing.

12. A switch as set forth in claim 8 wherein the biasing member is integrally formed with the switch arm.

13. A switch as set forth in claim 12 wherein the biasing member comprises a cantilevered spring.

14. A switch as set forth in claim 13 wherein the cantilevered spring has a proximal end connected to the switch arm generally adjacent the fixed end of the switch arm, and a free distal end.

15. A switch as set forth in claim 13 wherein the cantilevered spring comprises an integral portion of the switch arm extending longitudinally of the switch arm.

16. A switch as set forth in claim 15 wherein said integral portion of the switch arm comprises an elongate rectangular strip.

17. In a switch for an electric motor having a wall defining a housing and an electrical terminal in the housing, a flexible switch arm having a fixed end and a free end movable between a first position in which the arm engages the electrical terminal making an electrical contact affecting operation of the motor and a second position in which the arm is spaced from the electrical terminal, and a pivotally mounted lever engageable with the switch arm for movement of the switch arm between said first and second positions, wherein the improvement comprises a cantilevered spring attached to the switch arm and engaging the lever to urge the lever toward a generally stationary position against the wall of the housing to thereby inhibit vibration of the lever during operation of the motor.

* * * * *